US007621396B1

(12) United States Patent
Flores

(10) Patent No.: US 7,621,396 B1
(45) Date of Patent: Nov. 24, 2009

(54) DRILL BIT HOLDING SYSTEM

(76) Inventor: Patrick E. Flores, 1829 Highland Blvd., Hayward, CA (US) 94542

( * ) Notice: Subject to any disclaimer, the term of this patent is extended or adjusted under 35 U.S.C. 154(b) by 95 days.

(21) Appl. No.: 12/046,212

(22) Filed: Mar. 11, 2008

(51) Int. Cl.
*B65D 85/28* (2006.01)

(52) U.S. Cl. ..... 206/379; 206/443; 211/69

(58) Field of Classification Search ..... 206/379, 206/377, 376, 372, 373, 443; 211/69, 69.1, 211/70.6; 224/219, 222
See application file for complete search history.

(56) References Cited

U.S. PATENT DOCUMENTS

| | | | | |
|---|---|---|---|---|
| 4,508,221 | A | 4/1985 | Olson | |
| 4,797,040 | A | 1/1989 | Hibbard | |
| D314,699 | S | 2/1991 | Tamosaitis et al. | |
| D371,945 | S | 7/1996 | Geary et al. | |
| 5,842,584 | A | 12/1998 | Baird | |
| 6,729,480 | B1 | 5/2004 | Blake | |
| 6,910,578 | B2 | 6/2005 | Stern | |
| 2009/0120885 | A1* | 5/2009 | Kao | 211/70.6 |
| 2009/0139296 | A1* | 6/2009 | McCauley | 72/482.2 |
| 2009/0145865 | A1* | 6/2009 | Yu | 211/70.6 |
| 2009/0146032 | A1* | 6/2009 | Bettenhausen et al. | 248/220.31 |
| 2009/0166305 | A1* | 7/2009 | Hsieh | 211/70.6 |
| 2009/0184070 | A1* | 7/2009 | Kao | 211/70.6 |
| 2009/0194494 | A1* | 8/2009 | Kao | 211/70.6 |

* cited by examiner

*Primary Examiner*—Jacob K Ackun, Jr.

(57) ABSTRACT

A drill bit holding system includes a flexible panel that has a top side, a bottom side, a front edge, a rear edge, a first lateral edge and a second lateral edge. The panel comprises a flexible material that has a pair of openings therein extending through the top and bottom sides of the panel. A first opening of the pair of openings is positioned nearer to the first lateral edge and a second opening of the pair of openings is positioned nearer to the second lateral edge. A coupling assembly releasably couples the panel together to form a loop around a drill. The panel has a plurality of sets of apertures therein. Each of the sets includes a first aperture and a second aperture. Drill bits are removably extendable through associated ones of the first and second apertures to secure the drill bits to the panel.

12 Claims, 4 Drawing Sheets

DRILL BIT HOLDING SYSTEM

BACKGROUND OF THE INVENTION

Field of the Invention

The present invention relates to drill bit holding devices and more particularly pertains to a new drill bit holding device for holding drill bits to a housing of an electric drill while ensuring that there is proper airflow for the drill to preventing overheating thereof.

SUMMARY OF THE INVENTION

The present invention meets the objectives presented above by generally comprising a flexible panel that has a top side, a bottom side, a front edge, a rear edge, a first lateral edge and a second lateral edge. The panel comprises a flexible material that has a pair of openings therein extending through the top and bottom sides of the panel. A first opening of the pair of openings is positioned nearer to the first lateral edge than the second lateral edge. A second opening of the pair of openings is positioned nearer to the second lateral edge than the first lateral edge. A coupling assembly releasably couples the panel together to form a loop around a drill. The panel has a plurality of sets of apertures therein. Each of the sets includes a first aperture and a second aperture. Drill bits are removably extendable through associated ones of the first and second apertures to secure the drill bits to the panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
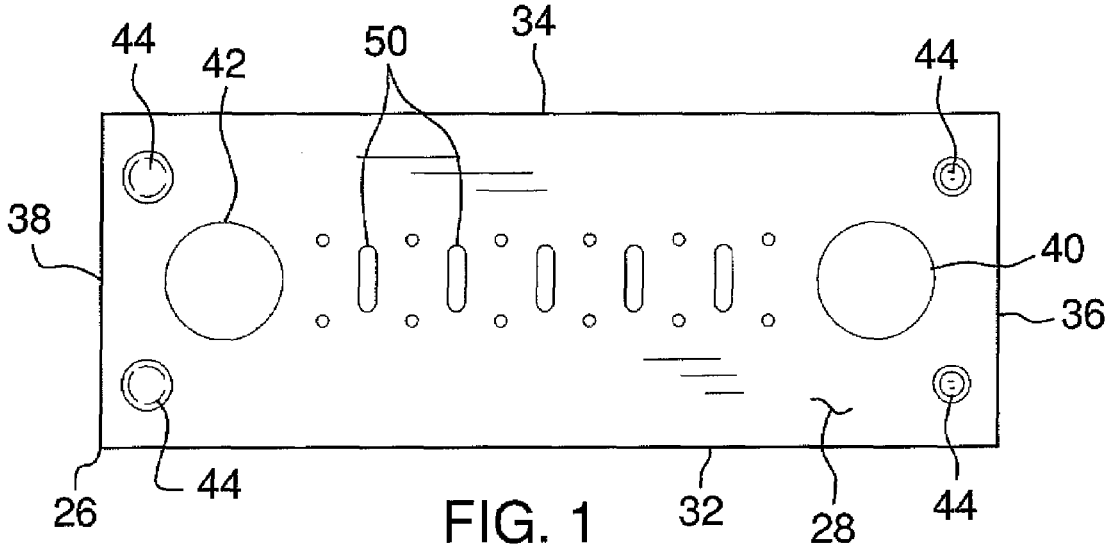
FIG. 1 is a top view of a drill bit holding system according to the present invention.
Figure 2:
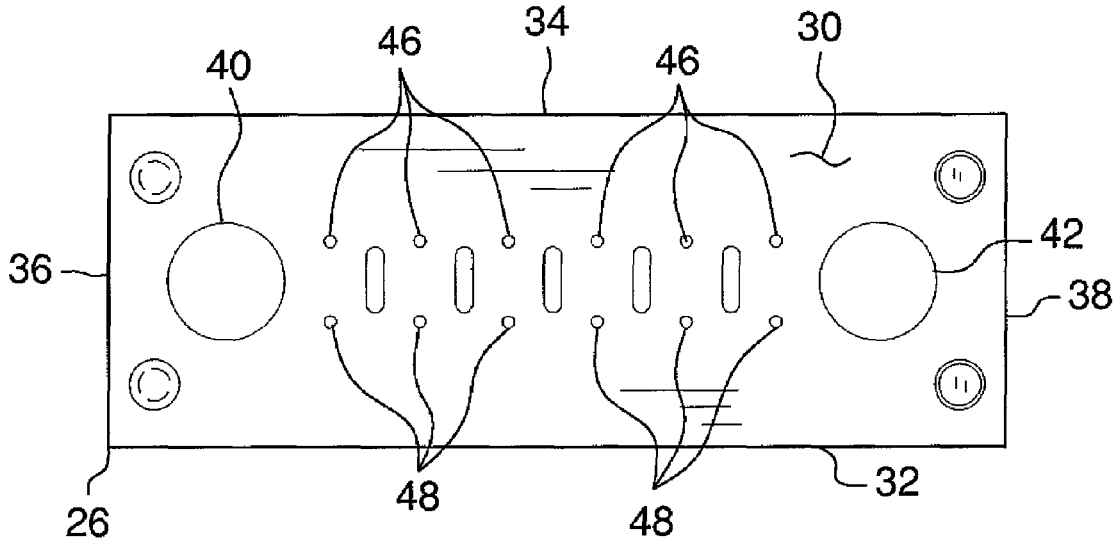
FIG. 2 is a bottom view of the present invention.
Figure 3:
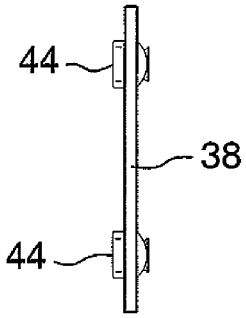
FIG. 3 is a left end view of the present invention.
Figure 4:
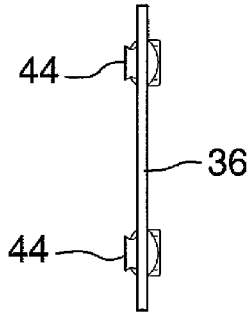
FIG. 4 is a right view of the present invention.
Figure 5:
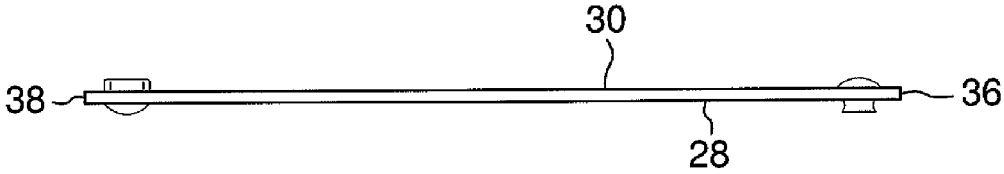
FIG. 5 is a front view of the present invention.
Figure 6:
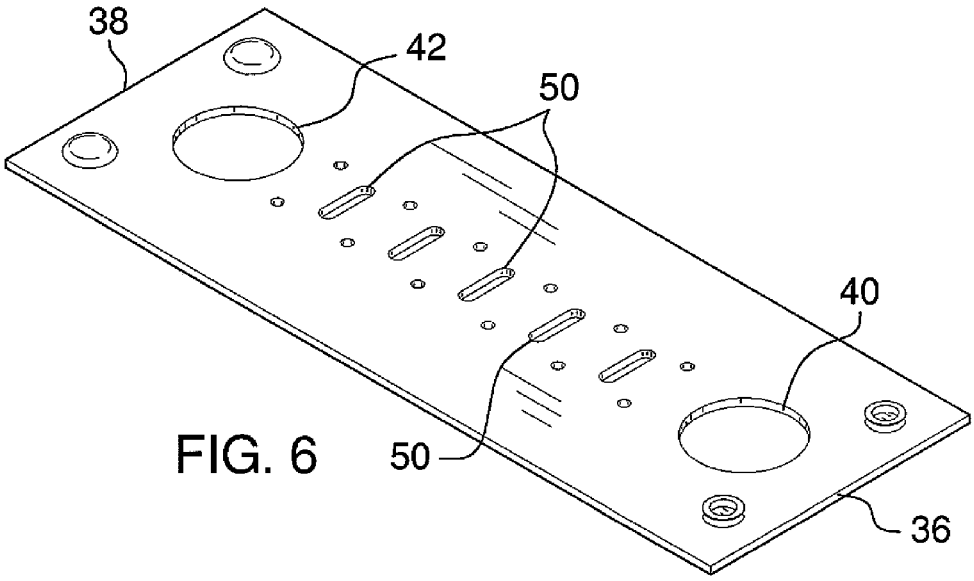
FIG. 6 is a top perspective view of the present invention.
Figure 7:
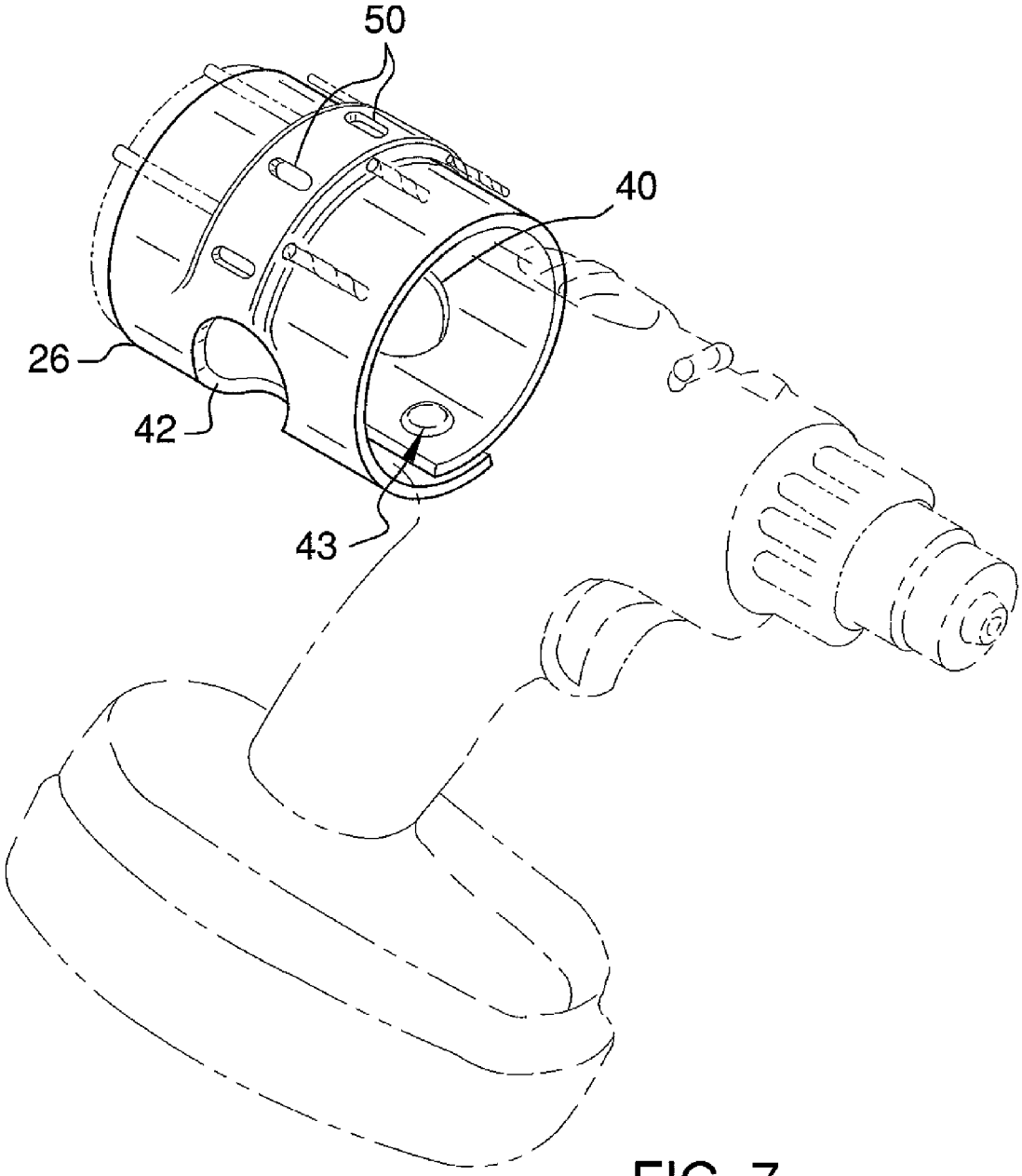
FIG. 7 is a perspective in-use view of the present invention showing a drill in phantom.
Figure 8:
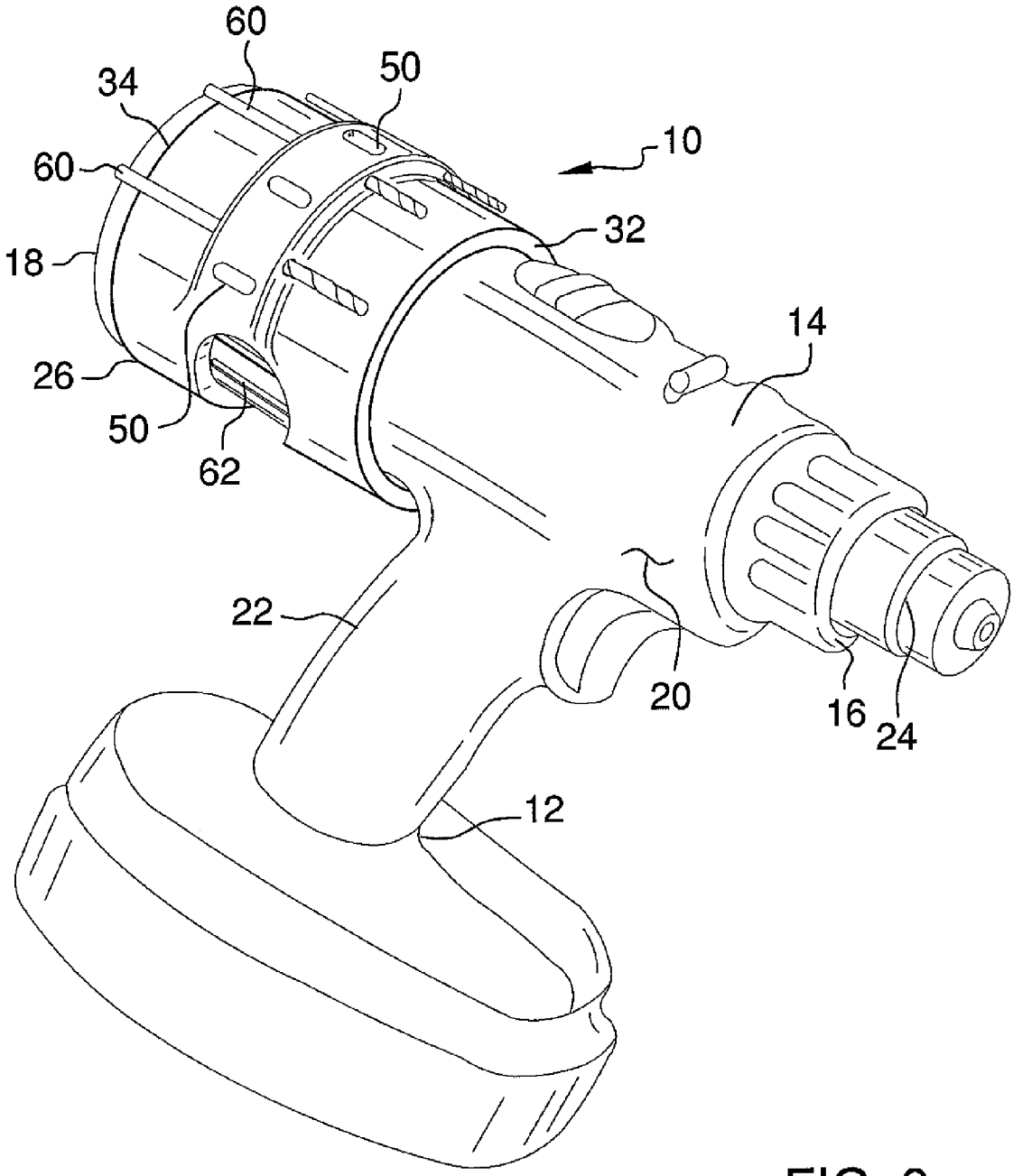
FIG. 8 is a perspective in-use view of the present invention.

With reference now to the drawings, and in particular to FIGS. 1 through 8 thereof, a new drill bit holding device embodying the principles and concepts of the present invention and generally designated by the reference numeral 10 will be described.

As best illustrated in FIGS. 1 through 8, the drill bit holding system 10 generally comprises an electric drill 12 that includes a housing 14 with a front end 16, a rear end 18 and a perimeter wall 20 attached to and extending between the front 16 and rear 18 ends. A handle 22 is attached to a medial portion of the perimeter wall 20. A drill bit coupler 24 is coupled to the front end 16 of the housing 14.

A flexible panel 26 has a top side 28, a bottom side 30, a front edge 32, a rear edge 34, a first lateral edge 36 and a second lateral edge 38. The panel 26 comprises a flexible and resiliently stretchable material. The panel 26 has a length from the first lateral edge 36 to the second lateral edge 38 greater than a distance extending around the perimeter wall 20 adjacent to a rear end 18 of the drill 12. The panel 16 has a pair of openings 40, 42 therein extending through the top 28 and bottom 30 sides of the panel 26. A first opening 40 of the pair of openings is positioned nearer to the first lateral edge 36 than the second lateral edge 38. A second opening 42 of the pair of openings is positioned nearer to the second lateral edge 38 than the first lateral edge 36. Each of the openings 40, 42 bounds an area equal to at least 1 $in^2$.

A coupling assembly 43 releasably couples the panel 26 together to form a loop around the drill 12 between the rear end 18 and the handle 22. The coupling assembly 43 secures the top side 28 of the panel 36 adjacent to the first lateral edge 36 to the bottom side 30 of the panel 26 adjacent to the second lateral edge 38. The coupling assembly 43 includes a pair of snaps each including two snap portions 46 snappily coupled together. The snap portions 46 are positioned between a respective one of the first 36 and second 38 lateral edges and an adjacent one of the first 40 and second 42 openings.

The panel 26 has a plurality of sets of apertures therein. Each of the sets includes a first aperture 46 and a second aperture 48. Drill bits 50 are removably extendable through associated ones of the first 46 and second 48 apertures to secure the drill bits 60 to the panel 26. The first apertures 46 are aligned with a corresponding one of the second apertures 48 along a line oriented perpendicular to the front edge 32. The first apertures 46 are spaced from the second apertures 48 a distance between 0.5 inch and 2.5 inches. The first apertures 46 of each of the sets of apertures are aligned with each other along a line oriented perpendicular to the first lateral edge 36. The second apertures 48 are each aligned with each other as well.

The panel 26 has a plurality of elongated slits 50 extending therethrough. Each of the slits 50 is positioned between adjacent ones of the sets of apertures 46, 48 so that one slit 50 is positioned between each of the adjacent ones of the sets of apertures 46, 48.

In use, the panel 26 secures drill bits 60 to the drill 12 so that they are easily accessible and there will be less chance of dropping or losing the drill bits 60 while they are being changed out. Further, the openings 40, 42 and the slots 50 allow the drill 12 to vent air through air venting slits 62 in the housing 14. This will prevent the overheating of the drill 12 as the panel 26 will not block air flow.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bit holding apparatus comprising:

a flexible panel having a top side, a bottom side, a front edge, a rear edge, a first lateral edge and a second lateral edge, said panel comprising a flexible material, said panel having a pair of openings therein extending through said top and bottom sides of said panel, a first opening of said pair of openings being positioned nearer to said first lateral edge than said second lateral edge, a second opening of said pair of openings being positioned nearer to said second lateral edge than said first lateral edge;

a coupling assembly releasably coupling said panel together to form a loop around a drill; and said panel having a plurality of sets of apertures therein, each of said sets including a first aperture and a second aperture, wherein drill bits are removably extendable through associated ones of said first and second apertures to secure the drill bits to said panel.

2. The apparatus according to claim 1, wherein each of said openings bounds an area equal to at least 1 $in^2$.

3. The apparatus according to claim 1, wherein said coupling assembly secures said top side of said panel adjacent to said first lateral edge to said bottom side of said panel adjacent to said second lateral edge, said coupling assembly including a pair of snaps each including two snap portions snappily coupled together, said snap portions being positioned between a respective one of said first and second lateral edges and an adjacent one of said first and second openings.

4. The apparatus according to claim 1, wherein said first apertures are aligned with a corresponding one of said second apertures along a line oriented perpendicular to said front edge, said first apertures of each of said sets of apertures being aligned with each other along a line oriented perpendicular to said first lateral edge.

5. The apparatus according to claim 1, wherein said panel has a plurality of elongated slits extending therethrough, each of said slits being positioned between adjacent ones of said sets of apertures so that one slit is positioned between each of said adjacent ones of said slits.

6. A bit holding system comprising:

an electric drill including a housing including a front end, a rear end and a perimeter wall attached to and extending between said front and rear ends, a handle being attached to a medial portion of said perimeter wall, a drill bit coupler being coupled to said front end of said housing;

a flexible panel having a top side, a bottom side, a front edge, a rear edge, a first lateral edge and a second lateral edge, said panel comprising a flexible material, said panel having a length from said first lateral edge to said second lateral edge greater than a distance extending around said perimeter wall adjacent to a rear end of said drill, said panel having a pair of openings therein extending through said top and bottom sides of said panel, a first opening of said pair of openings being positioned nearer to said first lateral edge than said second lateral edge, a second opening of said pair of openings being positioned nearer to said second lateral edge than said first lateral edge;

a coupling assembly releasably coupling said panel together to form a loop around a drill; and said panel having a plurality of sets of apertures therein, each of said sets including a first aperture and a second aperture, wherein drill bits are removably extendable through associated ones of said first and second apertures to secure the drill bits to said panel.

7. The apparatus according to claim 6, wherein each of said openings bounds an area equal to at least 1 $in^2$.

8. The apparatus according to claim 6, wherein said coupling assembly secures said top side of said panel adjacent to said first lateral edge to said bottom side of said panel adjacent to said second lateral edge, said coupling assembly including a pair of snaps each including two snap portions snappily coupled together, said snap portions being positioned between a respective one of said first and second lateral edges and an adjacent one of said first and second openings.

9. The apparatus according to claim 6, wherein said first apertures are aligned with a corresponding one of said second apertures along a line oriented perpendicular to said front edge, said first apertures of each of said sets of apertures being aligned with each other along a line oriented perpendicular to said first lateral edge.

10. The apparatus according to claim 6, wherein said panel has a plurality of elongated slits extending therethrough, each of said slits being positioned between adjacent ones of said sets of apertures so that one slit is positioned between each of said adjacent ones of said sets of apertures.

11. The apparatus according to claim 9, wherein said panel has a plurality of elongated slits extending therethrough, each of said slits being positioned between adjacent ones of said sets of apertures so that one slit is positioned between each of said adjacent ones of said sets of apertures.

12. A bit holding system comprising:

an electric drill including a housing including a front end, a rear end and a perimeter wall attached to and extending between said front and rear ends, a handle being attached to a medial portion of said perimeter wall, a drill bit coupler being coupled to said front end of said housing;

a flexible panel having a top side, a bottom side, a front edge, a rear edge, a first lateral edge and a second lateral edge, said panel comprising a flexible material, said panel having a length from said first lateral edge to said second lateral edge greater than a distance extending around said perimeter wall adjacent to a rear end of said drill, said panel having a pair of openings therein extending through said top and bottom sides of said panel, a first opening of said pair of openings being positioned nearer to said first lateral edge than said second lateral edge, a second opening of said pair of openings being positioned nearer to said second lateral edge than said first lateral edge, each of said openings bounding an area equal to at least 1 $in^2$;

a coupling assembly releasably coupling said panel together to form a loop around said drill between said rear end and said handle, said coupling assembly securing said top side of said panel adjacent to said first lateral edge to said bottom side of said panel adjacent to said second lateral edge, said coupling assembly including a pair of snaps each including two snap portions snappily coupled together, said snap portions being positioned between a respective one of said first and second lateral edges and an adjacent one of said first and second openings;

said panel having a plurality of sets of apertures therein, each of said sets including a first aperture and a second aperture, wherein drill bits are removably extendable through associated ones of said first and second apertures to secure the drill bits to said panel, said first apertures being aligned with a corresponding one of said second apertures along a line oriented perpendicular to said front edge, said first apertures of each of said sets of apertures being aligned with each other along a line oriented perpendicular to said first lateral edge; and said panel having a plurality of elongated slits extending therethrough, each of said slits being positioned between adjacent ones of said sets of apertures so that one slit is positioned between each of said adjacent ones of said sets of apertures.

* * * * *